US005533806A

United States Patent [19]

Veltrop et al.

[11] Patent Number: 5,533,806

[45] Date of Patent: Jul. 9, 1996

[54] GUARD FOR INDUSTRIAL SIZE FOOD MIXER

[75] Inventors: Loren Veltrop, Deerfield; Joel G. Friedl, Bloomingdale; Roberto Nevarez, Kirkland, all of Ill.

[73] Assignee: Middleby Marshall Inc., Elgin, Ill.

[21] Appl. No.: 444,549

[22] Filed: May 19, 1995

[51] Int. Cl.[6] ..... B01F 15/00

[52] U.S. Cl. ..... 366/347; 366/206; 366/207

[58] Field of Search ..... 366/197, 203, 366/206, 207, 347, 349, 96–99; 99/348, 645

[56] References Cited

U.S. PATENT DOCUMENTS

| | | | |
|---|---|---|---|
| 2,014,734 | 9/1935 | Hoe | 366/347 X |
| 2,051,883 | 8/1936 | Morgan | 366/347 |
| 2,193,356 | 3/1940 | Green | 366/347 |
| 3,875,423 | 4/1975 | Kemper | 366/206 X |
| 4,900,160 | 2/1990 | Brooks et al. | 366/347 |
| 4,968,149 | 11/1990 | Loiselet et al. | 366/77 |
| 5,306,083 | 4/1994 | Caldwell et al. | 366/347 |
| 5,348,393 | 9/1994 | Pappas, Jr. | 366/347 X |

FOREIGN PATENT DOCUMENTS

| | | | |
|---|---|---|---|
| 521379 | 5/1940 | United Kingdom | 366/206 |

*Primary Examiner*—Charles E. Cooley

*Attorney, Agent, or Firm*—Laff, Whitesel, Conte & Saret, Ltd.

[57] ABSTRACT

A guard basket for protecting people working near an industrial food mixer for preventing them from placing their hands in the way of a mixing tool. The guard basket is made of massive stainless steel bars which are welded together. On each side of the guard basket, the steel bars rise to a level which form handles for providing a way of sliding the basket either into an operating position or removing the basket. A pin is mounted on the mixer adjacent each of the handles. Latches on the handles receive the pins so that the guard basket may swing down to a safety or guard position or up to give access to the bowl. A sensor prevents the mixer from operating when the guard basket is away from the safety or guard position. Another safety circuit requires the bowl and guard to be in a proper position for continuous operation, while allowing the user to jog the bowl into position.

16 Claims, 8 Drawing Sheets

GUARD FOR INDUSTRIAL SIZE FOOD MIXER

This invention relates to industrial food mixers and more particularly to guards for preventing a person from putting his hand into a bowl while such mixer is running.

BACKGROUND OF THE INVENTION

There are many types of food mixers ranging from small hand held appliances to very large scale mixers standing, perhaps, three to six feet tall. In the large scale mixers, the tool for stirring or mixing a food product is large enough and strong enough to injure a person, perhaps even tearing a hand or arm from the body.

Accordingly, suitable guards should be provided to prevent a person from getting close enough to the stirring tool to be injured. The trouble with such a guard is that the cook, or baker wants to have easy access during the mixing process. For example, a person might want to repeatedly taste the mix and to add flavoring or other ingredients, and then to taste again while the mixing is in progress. As a result, the guard must be removed from and then returned to the mixer. However, if the removal of the guard is difficult and troublesome, the temptation will be to operate the food mixer without having the guard in place. Accordingly, it should be possible to easily install, remove, and reinstall the guard. Also, the mixer should be arranged so that it can not be operated unless the guard is in place.

For these and similar reasons, the prior art has provided a guard which the person using the mixer installs, releases, lifts off, and then replaces. This requires the person to have a near by table or other support to set the guard down after it is removed. The mixer may not be shut down promptly so that there is a hazardous, unguarded interval. Also, matching the guard to its clips, points of attachment or the like will require some time period each time that the guard is installed or reinstalled.

SUMMARY OF THE INVENTION

Accordingly, an object of the invention is to provide new and improved means for guarding the zone of a very large food mixer which gives access to a mixing tool. Here, an object is to provide a guard which may be swung into or out of place with almost no effort in order to restrict or give access to a mixing bowl. In this connection, an object is to provide a guard which may be removed and reinstalled, quickly and easily.

In keeping with the invention, these and other objects are accomplished by a somewhat basket shaped guard which slides onto pins on opposite sides of the mixer. As it is so installed, a keeper latch on the guard automatically rides over the pins on opposite sides of the mixer which act as hinge pins. The guard basket may swing on these hinge pins and move into either a protective down position or up into a clear access position. For removal of the guard, a person may simultaneously push the latches with his thumbs while he grasps the guard in order to remove it by sliding it off the hinge pins on the mixer.

BRIEF DESCRIPTION OF DRAWINGS

A preferred embodiment of the invention is shown in the attached drawings in which.

DETAILED DESCRIPTION

Figure 1:
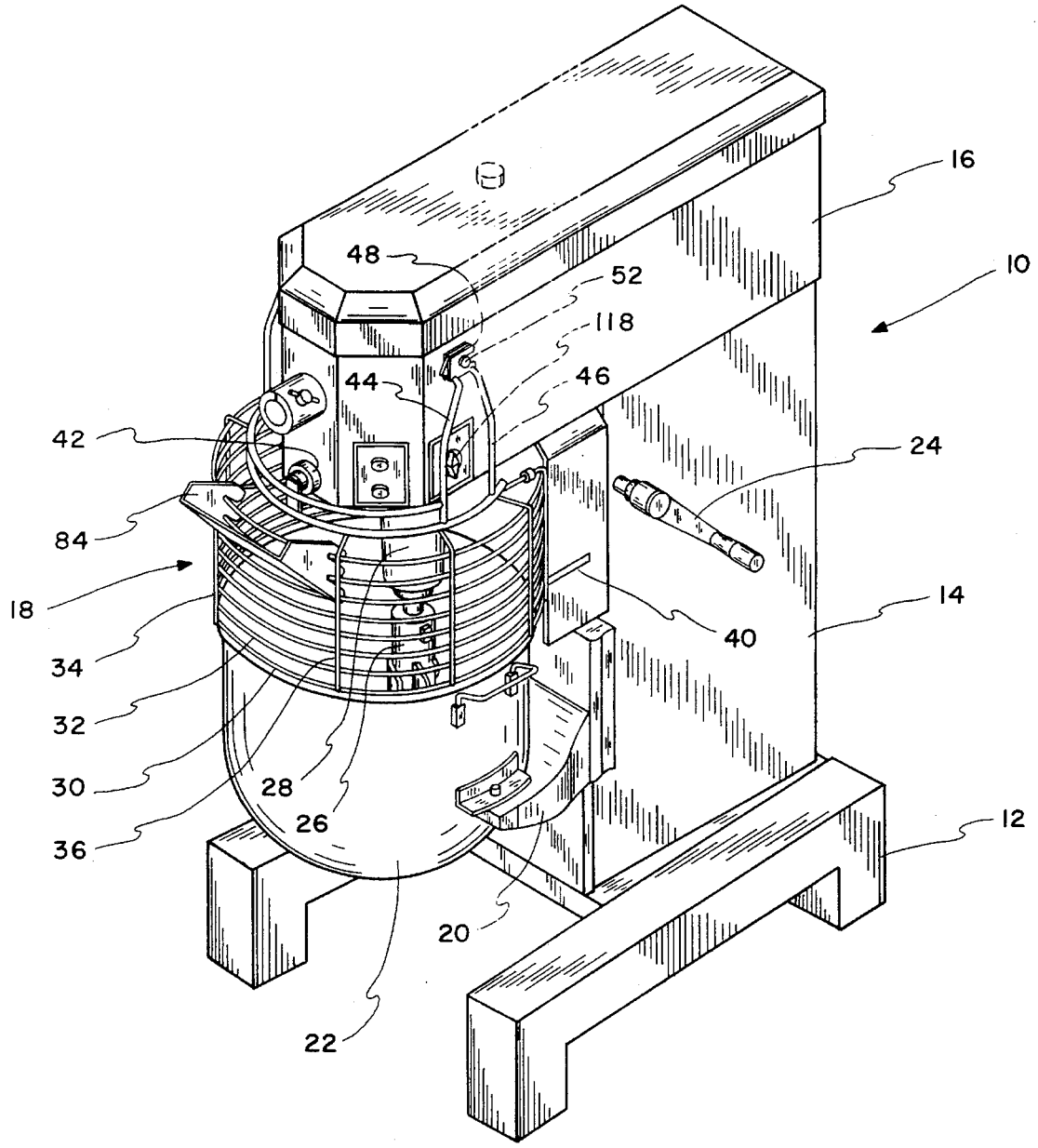
FIG. 1 is a perspective view of an industrial food mixer with the inventive guard basket in place.

The major parts of the inventive mixer 10 (FIG. 1) are a support 12, a housing body 14, a super structure 16, and the inventive guard basket 18. The support 12 may take any suitable form provided that it is large enough to give stability to a machine which may be about as tall as a person who may use it.

The body 14 includes an elevator mechanism having a bowl support fork 20 for receiving a mixing bowl 22 which may be lifted off or set on the fork. Bowl 22 simply rests under gravity while it is on the fork 20. A crank 24 raises or lowers the fork 20. Therefore, to install or remove a mixing bowl, the crank 24 is turned to lower the bowl support fork 20 far enough so that the bowl 22 may be put into place or removed with the mixing tool 26 in place. Thereafter, the crank 24 is turned and fork 20 raises the bowl 22 into an operative position where mixing tool 26 stirs any ingredients that may be in the bowl.

A motor and any other suitable drive may be located at any suitable place within either the housing 14 or super structure 16. When the motor is running, a rotary member 28 turns about a center axis. The mixing tool 26, which is mounted off center on rotary member 28, turns with the rotary member, orbiting about the center axis. As it so orbits, the mixing tool stirs the ingredients in the mixing bowl 22. The mixing tool 26 may be made in any of many suitable forms, which may be changed as needed.

The inventive guard 18 is a basket-like member made of suitable material such as stainless steel bars about 3/16 to ¼-inches in diameter which are welded together to form a grid that surrounds and encloses all open space through which a person might reach into the bowl 22. A number of these bars (such as 30, 32) are bent into an arcuate shape, enclosing any open space which is large enough for a person to be injured. These arcuate bars are held in a spaced parallel relationship by a series of vertical bars, such as 34, 36. A side guide 40 on the side of the mixer closes space between and fixes the relative positions of the guard basket 18 and the housing body 14. The side guide forces the basket 18 into a position which prevents any one from reaching around behind the guard basket in order to put their hand into bowl 22.

An inductive proximity sensor 42 is positioned adjacent a tab 43 (FIG. 9) welded to the guard basket, the tab being arranged to confront a magnetically controlled contact in sensor 42, if the guard basket 16 is firmly and properly in place. If the guard basket is moved out of its position, tab 43 moves away from sensor 42 and the magnetically controlled contacts open to stop the machine. The sensor 42 may also take any other suitable form, such as a combination of a light source and photocell. The photocell picks up light reflected from a guard basket bar; or, the guard basket bar cuts a beam of light and prevents it from reaching the photocell. In any event, unless the guard basket 18 is in a proper guarding position, the sensor 42 prevents food mixer 10 from running.

Figure 2:
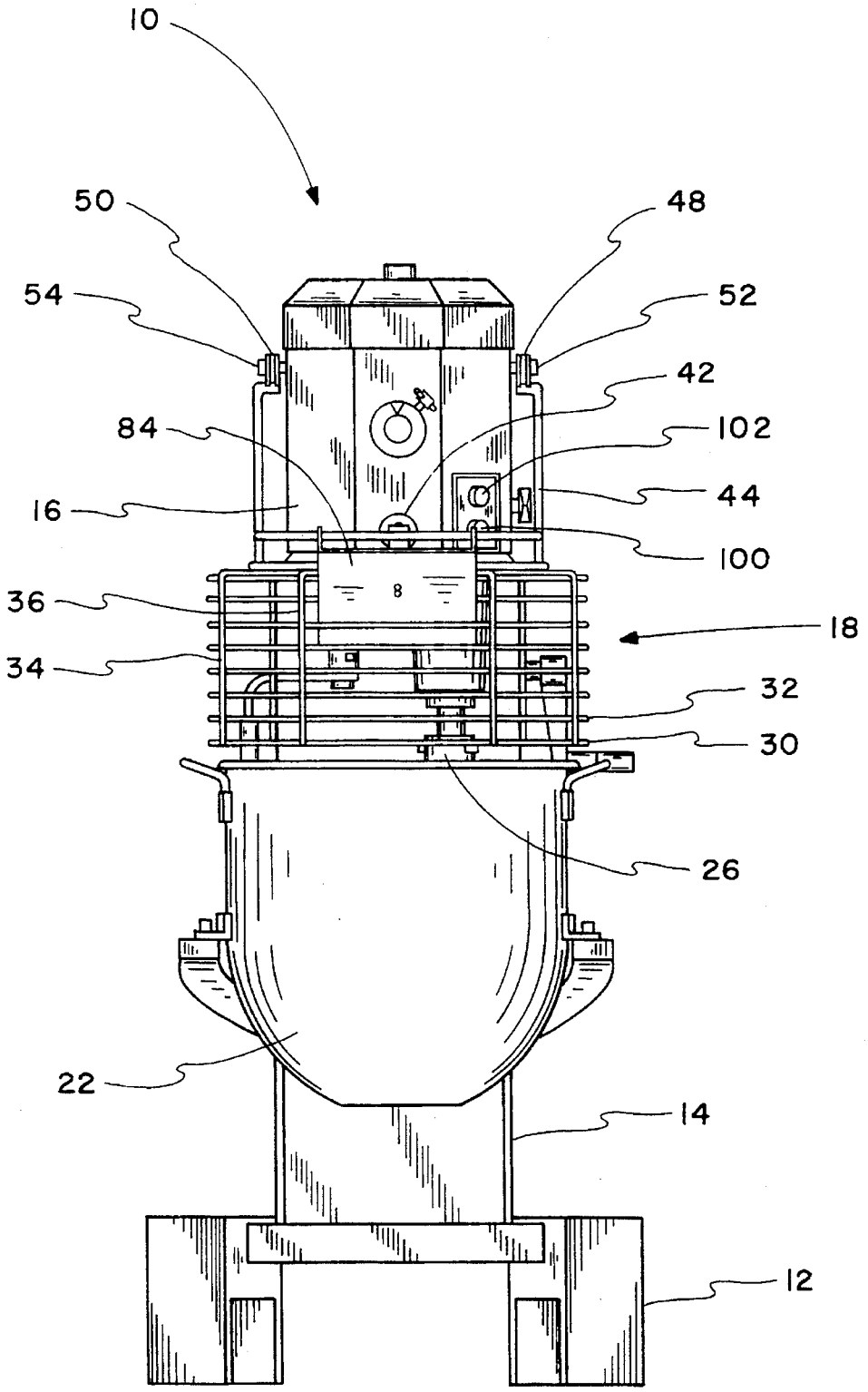
FIG. 2 is a front elevation of the food mixer of FIG. 1.

On each side, the guard basket 18 has two vertical rods 44, 46 forming a handle which rises above the guard basket and to an attachment point where they terminate in oppositely disposed latches 48, 50 (FIG. 2). These latches fit over individually associated hinge pins 52, 54 on opposite sides of the superstructure 16 of the mixer, thereby forming a latch mechanism for securing the guard basket when in place.

Figure 5:
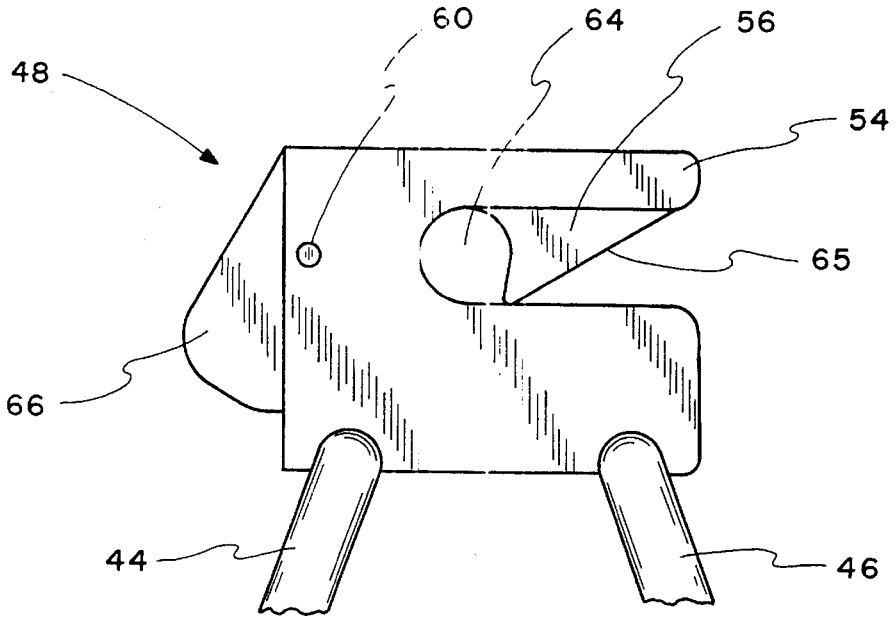
FIG. 5 is a side elevation of a latch mechanism used to capture hinge pins on opposite sides of the food mixer.
Figure 5A:
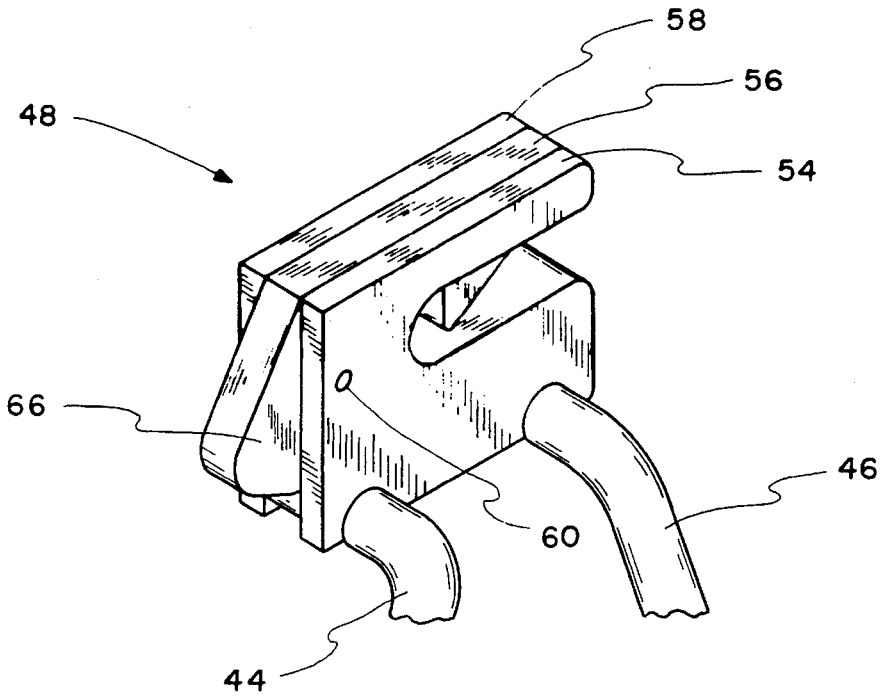
FIG. 5A is an enlarged detail, in perspective, showing the latch mechanism.
Figure 6:
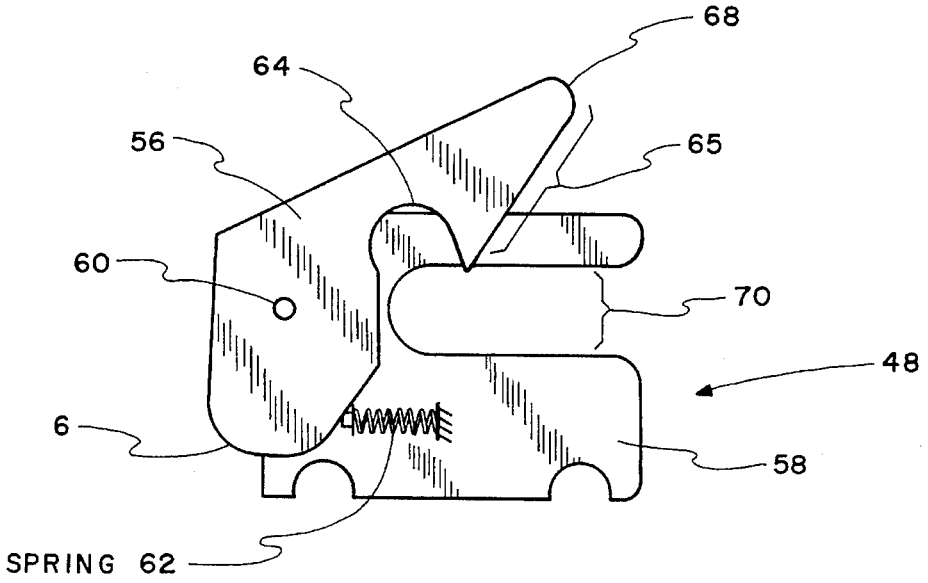
FIG. 6 is a stop motion view of the latch mechanism (with one stationary side plate removed) in a mount/dismount position while the guard basket is being installed or removed.

In greater detail, the latching mechanism is shown in FIGS. 5, 6. FIG. 5A is a detailed showing; FIG. 6 is shown with side plate 54 removed. Three plates 54, 56, 58 are in face-to-face contact. The two outside plates or one machined block 54, 58 are stationary, firmly welded to vertical bars 44, 46 on the guard basket. The center plate 56 is a keeper which is mounted on a hinge pin 60 and spring biased to a closed latch position by a compression spring 62. The diameter of hinge pin 52 fits easily into a cove 64 formed in the center keeper plate 56 of latch 48. The semicircular cove 64 has a diameter that matches the diameter of the pin 52.

On the keeper plate 56, the proximal or free end has a long and inclined side 65 which is a cam surface that automatically raises keeper plate 56 against the bias of spring 62 when engaged by the hinge pins 50, 52 while the guard basket is being mounted on the food mixer. At the latch position, the cove 64 and hinge pins 50, 52 are co-axial and cooperate to receive the pins in the coves and thereby latch the guard basket 18 onto the hinge pins.

Figure 7:
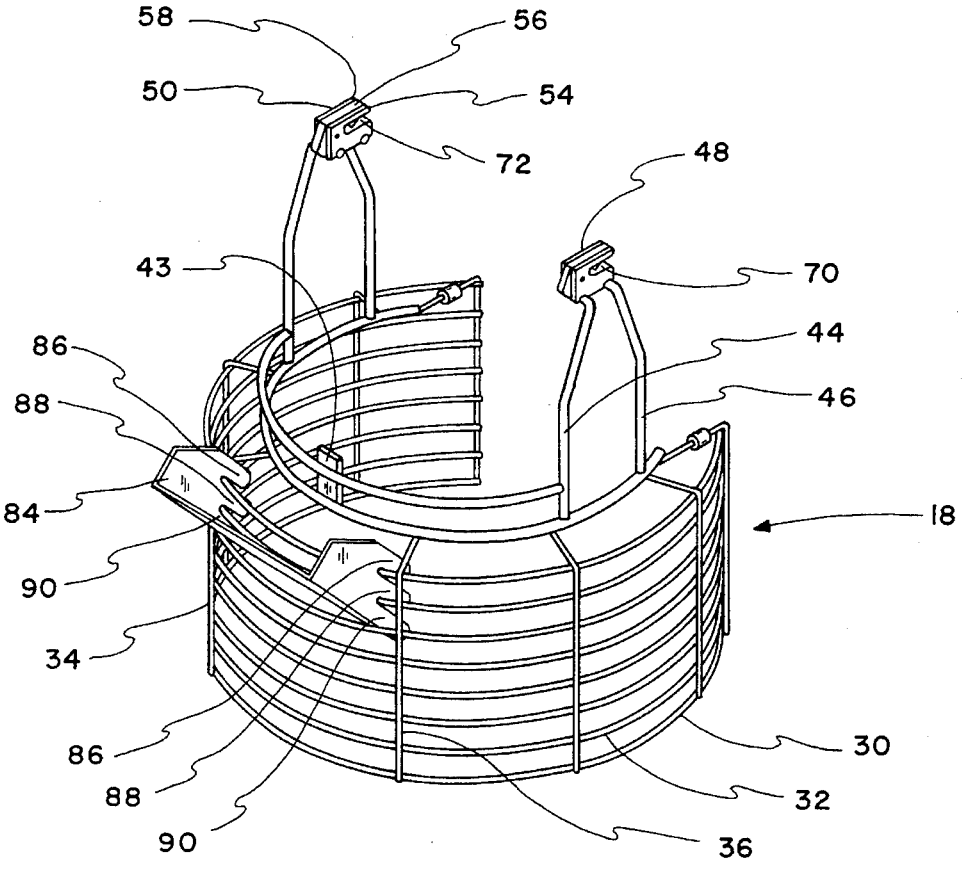
FIG. 7 is a perspective view and FIG. 8 is a top plan view of the guard basket with a chute which may be used to add ingredients to the product in the mixer while it is running with the guard basket in place.

The dimensions are such that when the fingers on a person's hand are gripping the handle forming bars 44, 46, the thumb on that hand is positioned near an actuation surface 66 on the keeper plates 56 of latches 48, 52. Therefore, the thumb may push surface 66 and thereby lift the outer end 68 of keeper plate 56, as the hand holding the bars 44, 46 pulls the guard basket 18 away from the pins 50, 52 on the food mixer housing. During the guard basket removal, the lifting of plate 56 removes cove 64 from over the hinge pins 50, 52 which then slide out of the grooves 70, 72 (FIGS. 6, 7) in the side latch plates 54, 58.

FIGS. 1–3, 7 show a tray or trough 84 which is simply a folded piece of sheet metal with a somewhat U- or C-shaped channel so that ingredients may be introduced into the mixer while it is running. The side walls of the tray have fingers 86, 88, 90 (FIG. 3) which fit over horizontal guard basket bars so that it easily but securely engages and rests on any of the guard basket bars. The weight of the distal end of the tray 84 causes it to swing under gravity into a somewhat downwardly position. While in this position a proximal end of tray 84 protrudes at 92, out in front of the guard basket 18. Therefore, if the user wants to add ingredients while the mixing is in progress, those ingredients may be poured into the protruding end 92 of tray 84. For example, the user may use the tray 84 to add flour, a cup of milk, an egg, or the like at some critical point in the preparation of, say, a cake dough.

Figure 8:
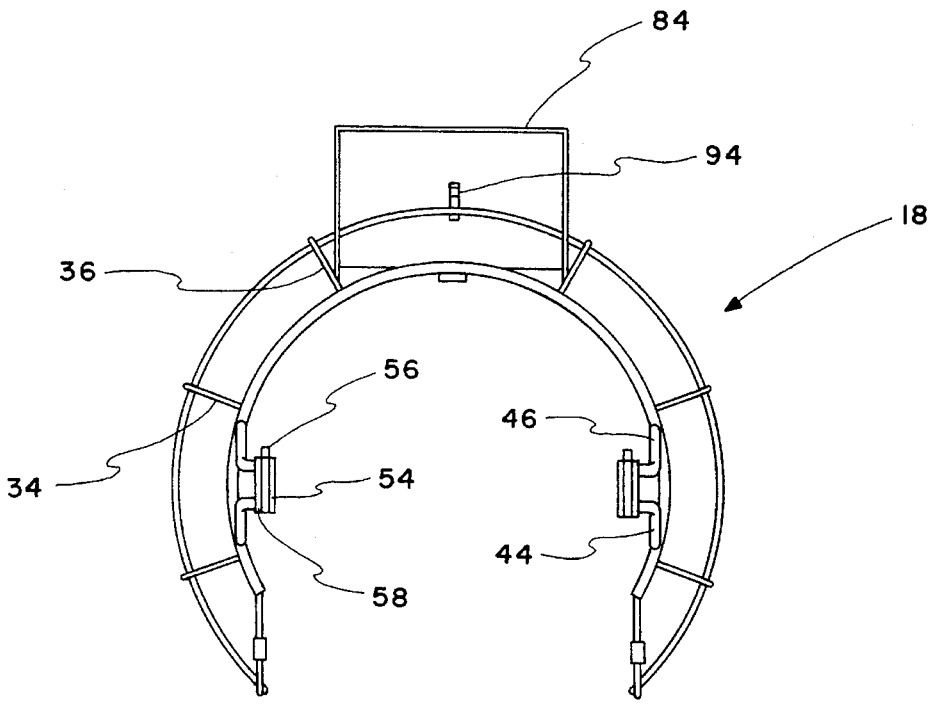

The tray 84 is held in place by a spring clip 94 (FIG. 8) bolted to the tray 84 bottom. Clip 94 snaps over a bar on the guard basket when the tray is pushed into position and snaps off the bar when the tray is pulled out of the guard basket 18 or tray may have detent button to snap over bar.

Figure 10:
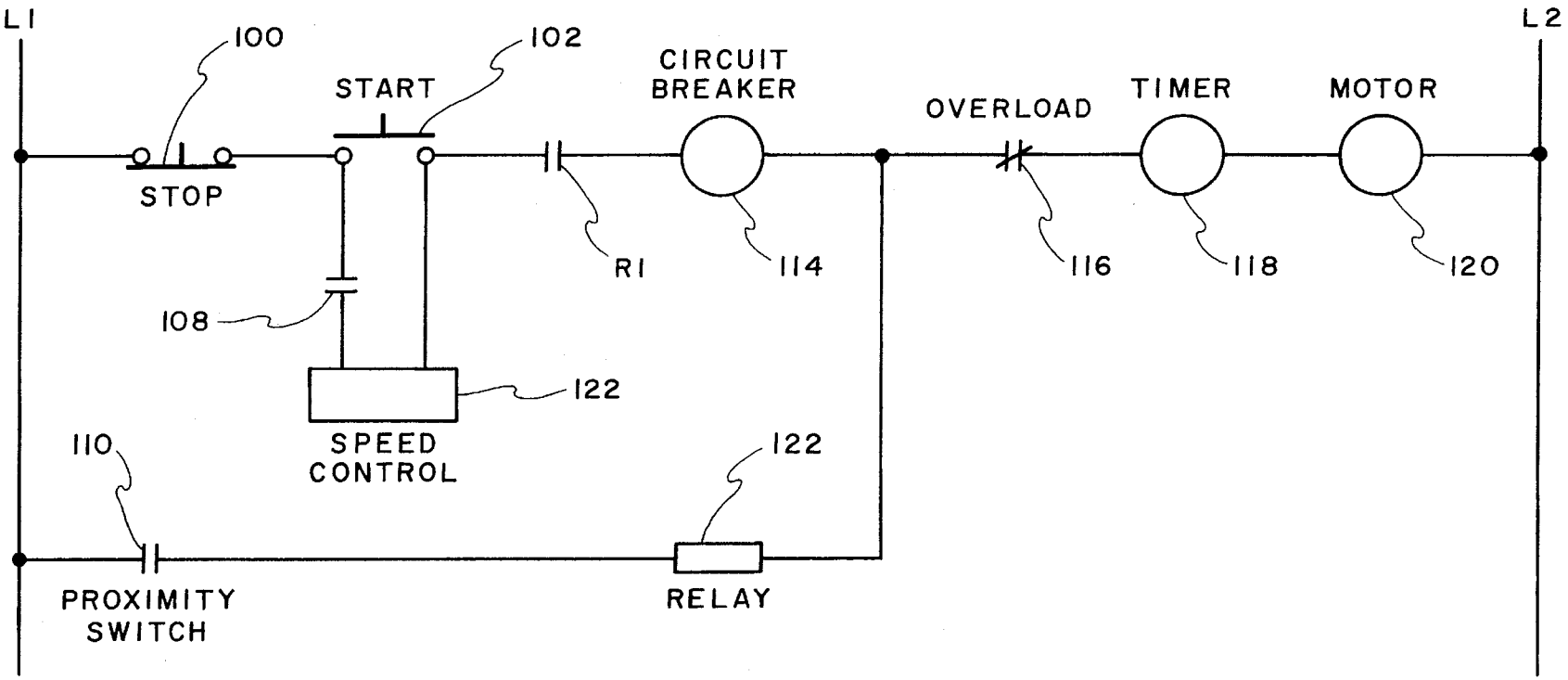
FIG. 10 is a schematic circuit diagram showing the electrical controls for the mixer.

The electrical control circuit for mixer 10 is shown in FIG. 10. The circuit for operating motor 120 may be traced from power line L1 through stop switch 100, either start switch 102 or limit switch 108, relay contact R1, circuit breaker 114, overload switch 116, timer 118, and motor 120 to power line L2.

In greater detail, the controls of the mixer include a stop button 100 and a start button 102 which start and stop the mixer. The mixer has a crank handle 24 (FIG. 3) which turns a bevel gear 104 which meshes with a jack screw 106. When the crank 24 is turned, jack screw 106 rotates.

Limit switch means are provided for enabling said mixer for continuous run only when said bowl is in a proper position, relative to the position of guard basket 18, while enabling said bowl to be jogged into position regardless of these relative positions. In greater detail, the bowl fork has bearing block 107 which moves up and down responsive to the rotation of jack screw 106. When the bowl is raised to a level where the bowl abuts against and is protected by the guard basket, the bearing block 107 engages and operates a microswitch 108 which is a limit switch affixed to the wall inside housing 14. When the microswitch operates it closes a circuit for enabling the mixer to operate. If the crank is turned to lower bowl 22 in the slightest amount, bearing block 106 disengages the limit switch 108 which opens to disable the mixer and keep it from operating.

Figure 3:
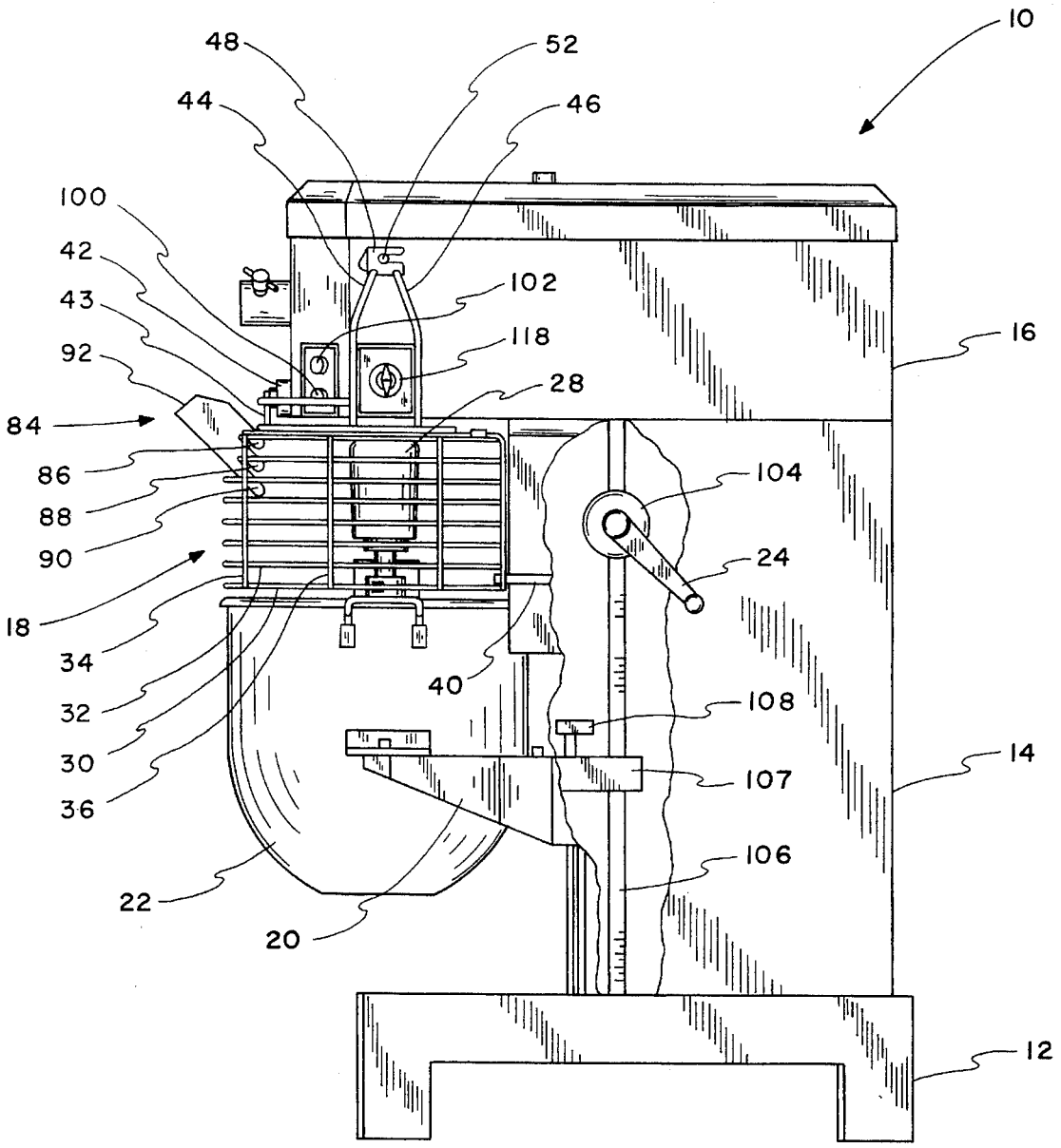
FIG. 3 is a side elevation with a part of the housing broken away to show a safety limit switch that is closed when the bowl is in a protected position.
Figure 4:
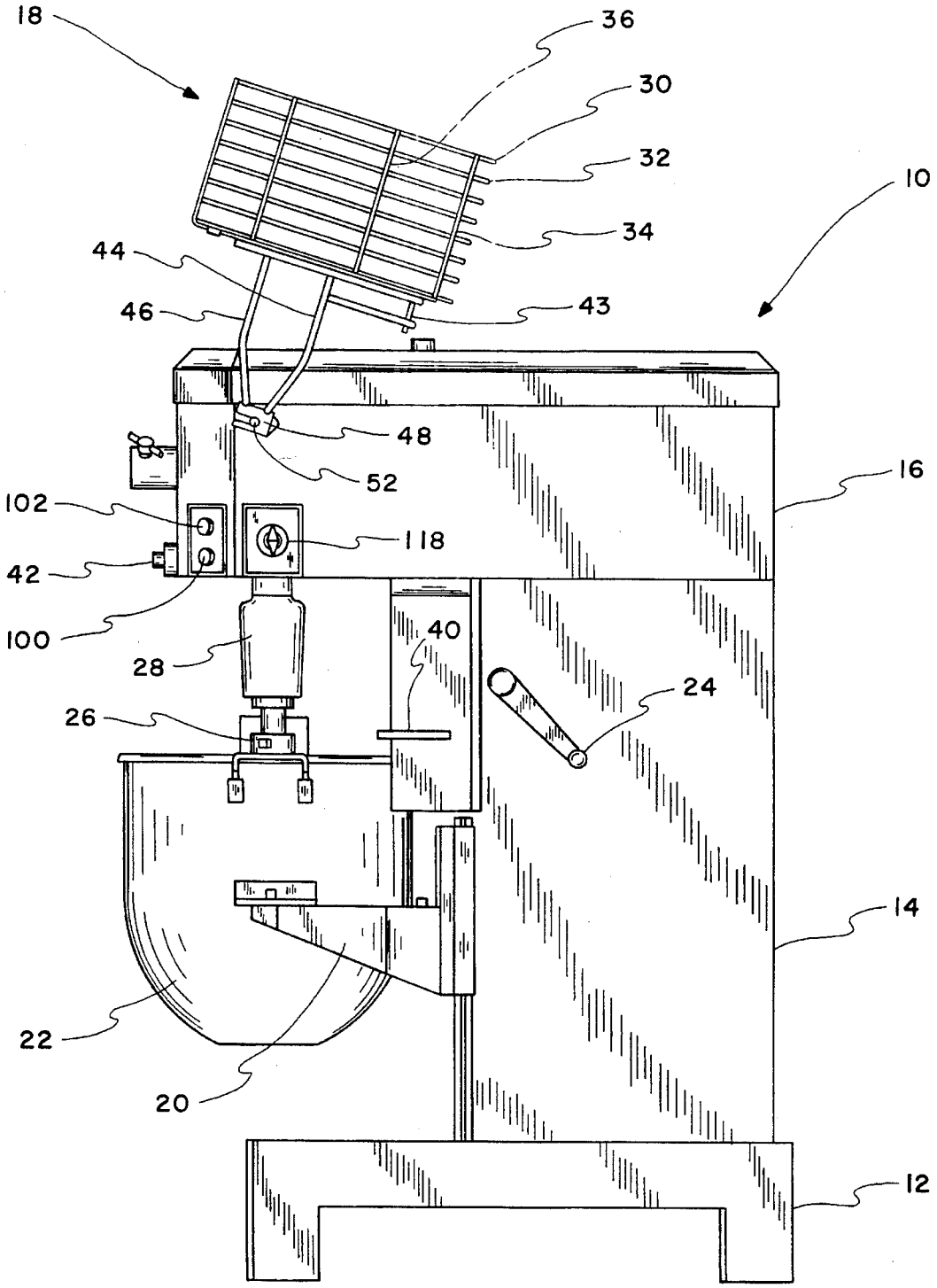
FIG. 4 is a side elevation of the mixer of FIG. 1 with the guard basket swing up and into a position which gives access to the bowl position.
Figure 9:
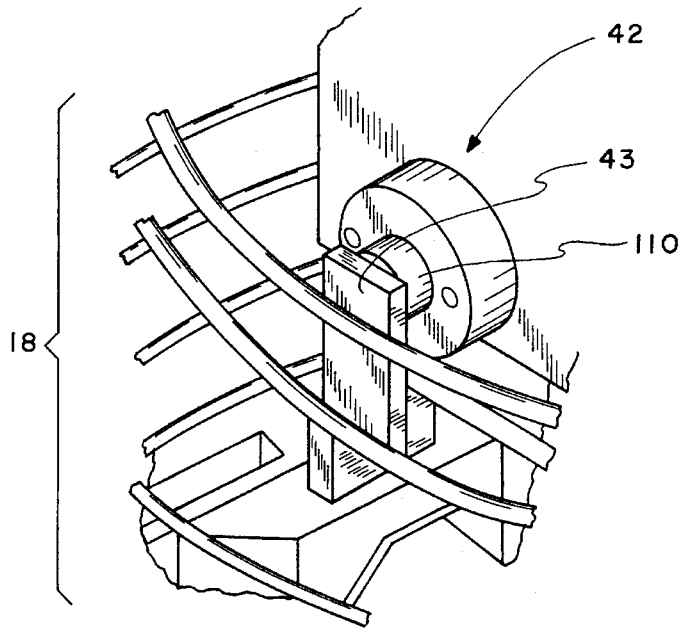
FIG. 9 is a fragment of FIG. 1 showing a proximity switch for indicating when the guard basket is in a protective position.

The proximity switch 42 is shown in detail in FIG. 9. A magnetic switch at 110 is closed when tab 43, made of magnetic material, is brought into a close proximity by swinging the guard basket 18 into a closed position (FIG. 3). If the guard basket 18 is moved away from its protecting position, magnetic contacts 110 open.

Relay 122 opens and closes relay contacts R1 which are provided to carry the heavy current required to run the motor 120. The proximity switch 110 which closes a circuit to the motor cannot carry such a heavy current; therefore, relay contacts R1 are merely a high voltage equivalent of the proximity switch. If the guard basket 18 is not in a proper operating position, contacts R1 are open and nothing powered by the motor can occur.

In operation, the motor will not run if the guard basket 18 is out of position; however, if the bowl guard basket 18 is correctly positioned, proximity switch 110 closes and operates relay 122 to close contacts R1. The bowl 22 is placed in the bowl fork 20 and the crank 24 is turned to raise the bowl. This raising can be done regardless of whether the motor is or is not running. However, if the bowl 22 contains a heavy substance, it takes brute force to turn crank 24 while the motor is stopped.

Means are provided for jogging the motor even if the bowl fork is too low—but not if the guard basket 18 is out of position—since it is easier to raise a filled bowl with the motor running. However, the jogging circuit requires the operator's finger to be in a location where the hand is out of harm's way. If the finger is removed, the motor stops instantly.

In greater detail, with the guard basket down, the start switch 102 is pushed to close a circuit in parallel with the open limit switch, microswitch 108. The motor runs to turn the mixer blade. However, if the operator removes his finger from the start switch, the motor stops instantly because limit switch contacts 108 are open. Therefore, the operator is turning crank 24 with one hand and pushing start button 102 with the other hand so that neither hand is near the mixer blade during jogging.

As the turning of crank 24 brings the bowl to the proper position, bearing block 107 engages and closes microswitch 108. A circuit is completed through a speed control circuit 122 so that the motor 120 continues to run after the start switch is released. The motor 120 will continue to run for a time period selected by a manual operation of timer 118, unless the stop button 100 is pushed to open the circuit to the motor.

Those who are skilled in the art will readily perceive how to modify the invention. Therefore, the appended claims are to be construed to cover all equivalent structures which fall within the true scope and spirit of the invention.

The claimed invention is:

1. A guard system for preventing a person from putting his hand into a mixing bowl on an industrial sized food mixer having a mixing tool fitting into the mixing bowl, said guard system comprising a guard basket shaped to enclose substantially all open space between said mixer and said mixing bowl and in an area giving access to the mixer tool, said guard basket having oppositely disposed handle means raising above the basket, a pair of latch means attached to upper ends of said handle means, and hinge pin means on opposite sides of said mixer for receiving said latch means, said guard basket swinging on said hinge pin means between an out of the way location and a space enclosing operating position.

2. The guard system of claim 1 wherein said guard basket is made of a plurality of bars attached to each other and shaped to form a grid.

3. The guard system of claim 2 and a tray which fits between and is captured by said bars which form said guard basket whereby ingredients may be added to said bowl via said tray without having to swing said guard basket to said out of the way location.

4. The guard system of claim 1 and means for operating said mixer, and means for preventing said operation of said mixer when said guard basket is not in a predetermined position enclosing all of said open space.

5. The guard system of claim 4 wherein said means for preventing said operation of said mixer includes a magnetically operated proximity switch which depends for its operation upon the guard basket being in said predetermined position enclosing all of said open space.

6. The guard system of claim 1 wherein each of said latch means comprises a pivoted spring biased keeper plate for receiving and trapping said hinge pin means on opposite sides of said mixer, said hinge pins means sliding away from a hinge pin trapping position when said pivoted keeper plate is manually operated against said spring bias.

7. The guard system of claim 6 wherein said pivoted keeper plate has a cove shape for fitting over and capturing said hinge pin means when said guard basket is mounted on said mixer, said pivoted keeper plate providing a quick release for removing said cove shape from said hinge pin means by a movement of a thumb on a hand holding said handle means on guard basket.

8. A guard system featuring a quick connect and release guard for use with an industrial size food mixer, said guard comprising a pair of latches attached to a guard basket, each of said latches having a longitudinal groove forming a horizontal track when said guard basket is mounted in an operating position on said mixer, said latches being adapted to be attached to and removed from pins projecting from opposite sides of said food mixer, said pins sliding through said grooves to their distal end during a mounting of said guard basket on said mixer; an elongated keeper plate pivotally attached to each of said latches, a front edge of said keeper plate having a cam surface thereon for automatically raising said pivotally attached keeper plate when engaged by said pin sliding along said groove; and means including said pin and a capture cove for selectively locking said guard basket in a protective position or for enabling said guard basket to swing to an out-of-the-way position.

9. The guard system of claim 8 wherein said guard basket has oppositely disposed gripping means, each of said gripping means being individually associated with a corresponding one of said latches, and means for releasing said pin from said latch while fingers on a hand are holding said gripping means and a thumb on said hand is releasing said elongated keeper plate in order to disengage said latch from said pin.

10. A guard system for an industrial food mixer comprising a support having a body housing standing thereon; a superstructure mounted on top of said body housing; a mixing bowl support mounted on said housing; means for raising and lowering said mixing bowl support relative to said housing; a mixing tool dependent from said superstructure for fitting into a mixing bowl on said mixing bowl support when said mixing bowl support is in a raised position; a guard basket surrounding said mixing tool and fitting over said bowl in said mixing bowl support when in said raised position; said guard basket covering substantially all of an area through which a person could thrust a hand between said housing, said superstructure, and said bowl on said mixing bowl support; a pin on each side of said superstructure; a pair of oppositely disposed latch means mounted on said guard basket and being adapted to receive said pins; means on said latch means for receiving and capturing said pins after the guard basket has moved into said area; and means on said guard basket associated with each of said pins on said superstructure for holding said guard basket in an operating position when said mixer is operating and for enabling said guard basket to swing on said pins and into an out of the way position when said mixer is not operating and for facilitating a release of said capture of said pins when said guard basket is to be removed from said mixer.

11. The guard system mixer of claim 10 and sensor means for preventing said mixer from operating if said guard basket is not captured in a predetermined guard position.

12. The guard system of claim 11 wherein said sensor means is a magnetically operated switch mounted in a position relative to said guard basket which closes or opens depending upon whether the guard basket is or is not in a safety position; and means for operating said mixer at least in part responsive to whether said switch is closed or opened.

13. The guard system of any one of the claims 1, 8 or 10 and a proximity switch comprising a magnetic switch mounted on said mixer in a position adjacent said guard basket only when said guard basket is in said operating position, a tab on said guard basket for operating said magnetic switch only when said guard basket is in said operating position.

14. The guard system of any one of the claims 1, 8 or 10 and means for enabling said mixer to operate continuously only when a bowl is in a proper position relative to said guard basket while enabling said mixer to be jogged to move said bowl into said proper position.

15. The guard system of any one of the claims 1, 8 or 10 and a proximity switch comprising a magnetic switch mounted on said mixer in a position adjacent said guard basket when said guard basket is in said operating position, a tab on said guard basket for operating said magnetic switch only when said guard basket is in said operating position, and limit switch means on said mixer for enabling said mixer to operate continuously only when a bowl is in a proper position relative to said guard basket while enabling said mixer to be jogged to move said bowl into said proper position.

16. The guard system of claim 15 and an electrical control circuit comprising a series circuit including a normally open non-locking switch, said proximity switch, and a motor for operating said mixer; and said limit switch means being connected in parallel with said non-locking switch.

* * * * *